US005615734A

United States Patent [19]

Hyp

[11] Patent Number: 5,615,734

[45] Date of Patent: Apr. 1, 1997

[54] SLUDGE LANCE INSPECTION AND VERIFICATION SYSTEM

[75] Inventor: Edward J. Hyp, Irwin, Pa.

[73] Assignee: Westinghouse Electric Corporation, Pittsburgh, Pa.

[21] Appl. No.: 340,695

[22] Filed: Nov. 16, 1994

[51] Int. Cl.[6] ..... F28F 27/00

[52] U.S. Cl. ..... 165/11.2; 165/95; 376/249

[58] Field of Search ..... 165/11.2, 11.1, 165/95; 376/248, 249, 405; 15/315

[56] References Cited

U.S. PATENT DOCUMENTS

| | | | |
|---|---|---|---|
| H1115 | 12/1992 | Nachbar | 165/11.1 |
| 4,079,701 | 3/1978 | Hickman et al. | 122/382 |
| 4,231,419 | 11/1980 | Gugel | 165/11.2 |
| 4,276,856 | 7/1981 | Dent et al. | 122/382 |
| 4,445,465 | 5/1984 | Byrd et al. | 122/392 |
| 4,515,747 | 5/1985 | Creek et al. | 376/249 |
| 4,575,185 | 3/1986 | Wentzell et al. | 350/96.26 |
| 4,638,667 | 1/1987 | Zimmer et al. | 73/432.1 |
| 4,661,309 | 4/1987 | Hayes | 376/248 |
| 4,702,878 | 10/1987 | Klug et al. | 376/249 |
| 4,715,324 | 12/1987 | Muller et al. | 122/381 |
| 4,760,876 | 8/1988 | Minogue | 165/11.2 |
| 4,844,021 | 7/1989 | Stoss | 122/392 |
| 4,848,278 | 7/1989 | Theiss | 122/383 |
| 4,971,140 | 11/1990 | Stoss | 165/95 |
| 5,036,871 | 8/1991 | Ruggieri et al. | 134/167 |
| 5,065,703 | 11/1991 | Lee | 122/382 |
| 5,069,172 | 12/1991 | Shirey et al. | 122/382 |
| 5,088,451 | 2/1992 | Hu et al. | 122/388 |
| 5,113,802 | 5/1992 | Le Blanc | 165/95 X |
| 5,165,841 | 11/1992 | Asano et al. | 165/11.2 X |
| 5,194,217 | 3/1993 | St. Louis et al. | 376/316 |
| 5,201,281 | 4/1993 | Cella | 122/382 |
| 5,265,129 | 11/1993 | Brooks et al. | 376/248 |

*Primary Examiner*—John Rivell
*Assistant Examiner*—Christopher Atkinson

[57] ABSTRACT

An apparatus for use with a search device and a foreign object extrication device in a steam generator includes a router having two conduits for routing the search and extrication devices, and a positioning mechanism for positioning the conduits. The extrication device may include a cable having a pushing mechanism for pushing a foreign object within the steam generator and a hook mechanism for pulling the foreign object. Alternatively, the extrication device may include a loop mechanism for pulling. The extrication device may include a cable having a slotted end for pushing. Alternatively, the cable may have an anvil for pushing. The router may include a guide tube interconnected with the first conduit for guiding the search device from the tube lane into a selected one of the tube rows of the steam generator and another guide tube interconnected with the second conduit for guiding the extrication device from the tube lane into the selected tube row. Alternatively, the two guide tubes may guide the search and extrication devices into the annulus. The router may also include an attachment for removably attaching the guide tubes to the conduits. Alternatively, the apparatus may be adapted for use with a sludge lancing system in a steam generator having a first half and a second half separated by a tube lane. The apparatus may include a router having four conduits for routing the search device and the extrication device from the tube lane into the two halves. Alternatively, the router may have four conduits for routing the search and extrication devices into two halves of the annulus of the steam generator. Alternatively, the router may have two conduits for positioning by the positioning device, two guide mechanisms for guiding the search and extrication devices, and a connection mechanism for removably connecting the two conduits to the two guide mechanisms. The connection mechanism may include two Y-conduits for two conduits and four guide tubes.

20 Claims, 8 Drawing Sheets

SLUDGE LANCE INSPECTION AND VERIFICATION SYSTEM

CROSS REFERENCE TO RELATED APPLICATION

This case is related to a commonly assigned copending application Ser. No. 08/286,489, filed Aug. 4, 1994, entitled "Powered Guide Tubes" by Edward J. Hyp (Attorney Docket No. 58,312).

BACKGROUND OF THE INVENTION

1. Field of the Invention

This invention relates to search, extrication and retrieval of foreign objects from a heat exchanger and more particularly to positioning search, extrication and retrieval devices for such objects within a nuclear steam generator. The invention also relates to positioning such devices within a nuclear steam generator using a sludge lancing system.

2. Background of Information

In a pressurized water nuclear powered electric generating system, the heat generated by a nuclear reactor is absorbed by a primary coolant that circulates through the reactor core and is utilized to generate steam in a steam generator. The steam generator typically is an upright cylindrical pressure vessel with hemispherical end sections. Such a generator typically comprises an outer vertically oriented shell, a horizontal plate called a tube sheet adjacent to the lower end of the shell, a bundle of vertical U-shaped tubes supported by the tube sheet, and a wrapper barrel inside of the outer shell surrounding the tubes and extending from the upper portion of the shell downwardly to a predetermined point above the tube sheet. The wrapper barrel forms a narrow annulus inside the shell and generally extends down to a point approximately twelve to fourteen inches above the tube sheet. The outer cylindrical shell is provided with one or more openings of limited size called handholes which are typically located about five to twenty-one inches above the tube sheet. These handhole openings are covered during operation of the steam generator but may be opened when the generator is shut down to permit access to the area inside for maintenance purposes.

Occasionally, during maintenance inside the steam generator, objects such as bolts, wires or other foreign objects are inadvertently introduced into the system and have to be removed. Due to the limited space within the generator, the annulus between the wrapper barrel and the shell generally is only about 1.5 to 2.75 inches wide, the space between the shell and the tubes is typically only about 4.5 inches wide, and the space between the bottom of the wrapper barrel and the tube sheet is usually only about twelve to fourteen inches high. The tubes in the tube bundle are typically spaced about 0.292 to 0.406 inches apart. Various objects may easily become entrapper between these closely spaced tubes. Therefore, it is difficult to locate, dislodge or remove such objects between the tubes on the tube sheet.

U.S. Pat. No. 5,065,703 discloses a flexible lance for use in a steam generator tube bundle. The flexible lance utilizes high-pressure water jets, a video camera and a sludge sample retrieval mechanism. The flexible lance includes a plastic extrusion having a plurality of conduits extending lengthwise along such plastic extrusion. The conduits have a helically wound cartridge brass core covered with a braided brass sheath. A flexible cable is movable within the plastic extrusion to operate a sludge sampler. A fiber optic cable is connected to inspecting optics in order to view the interior of the steam generator. The fiber optic cable, the plural conduits, and the flexible cable are routed through the longitudinal axis of the plastic extrusion.

U.S. Pat. No. 4,638,667 discloses a probe positioning apparatus which includes an elongated extensible boom and an elongated flexible probe carrier tape. The boom has an end which is adapted for extension into and retraction from the tube lane of a steam generator. The carrier tape has sprocket holes for transporting the probe. The end of the boom, which is located within the steam generator, has a tractor feed unit and two sprocket belts for feeding the carrier tape. A drive motor rotates the tractor feed unit 180° in order to investigate tube rows on both sides of the tube lane. Located outside of the steam generator is a tape withdrawing assembly which includes a drive motor and a sprocket for retrieving the carrier tape.

U.S. Pat. No. 4,760,876 discloses a transport system for an inspection system having an end effector which carries inspection and gripping devices, a hollow flexible conduit which passes control cables for the end effector therethrough, and a drive assembly which moves the flexible conduit in axial and rotational directions.

U.S. Pat. No. 4,702,878 discloses a device for searching and retrieving foreign objects on the tube sheet of a steam generator. The device includes a probe for searching for foreign objects on the surface of the tube sheet and a gripper for grasping one of the foreign objects. The device is inserted into the annulus using a guide tube having a straight main segment, an L-shaped upper segment which is bent at a right angle with respect to the main segment, and an L-shaped lower segment. The lower segment, which rests on the surface of the tube sheet, is bent at a right angle with respect to the main segment and extends in a direction rotated 90° from the direction of the upper segment. The upper segment is secured to the handhole by a guide plate. To facilitate insertion of the guide tube into the steam generator, the upper, main and lower segments are constructed from separate parts.

U.S. Statutory Invention Registration No. H1115 discloses a robot arm apparatus having two or more cascaded conduit elements and a flexible movable conduit. The flexible conduit passes through the cascaded conduit elements and conveys inspection and/or maintenance apparatus to the interior of a steam generator. The flexible conduit has a terminal working end which is translated into and around the interior of the steam generator. A first reversible motor translates the cascaded conduit elements in a first axis within the tube lane. A second reversible motor translates the flexible conduit in a direction perpendicular to the first axis. A third reversible motor rotates a carnage which carries the cascaded conduit elements and, thus, moves the terminal working end in a third direction of travel, which is a curved path.

It is known to manually utilize a pair of parallel guide tubes between one handhole and the tube lane in order to manually and independently position, through each of the parallel guide tubes, a search probe and a retrieval device. Such parallel guide tubes have an L-bend in order to manually and independently position, through each of the parallel guide tubes, a search probe and a retrieval device in an axis perpendicular to the tube lane. It is also known to manually utilize two guide tubes between one handhole and the annulus. These two guide tubes are used to manually and independently position a search probe and a retrieval device on the tube sheet within the annulus.

The handholes also provide access to the tube sheet for removal of sludge deposits on the tube sheet. An apparatus and method for removing such sludge from a steam generator are described in U.S. Pat. No. 4,079,701 entitled "Steam Generator Sludge Removal System," issued Mar. 21, 1978, and in U.S. Pat. No. 4,276,856 entitled "Steam Generator Sludge Lancing Method," issued Jul. 7, 1981, which are both incorporated herein by reference.

During a sludge lancing operation, a fluid injection header and a fluid suction header are placed at opposite handholes near the elevation of the cylindrical tube sheet. These cause a circumferential fluid stream to be established from the injection header around the tube bundle to the suction header. A tubular member having a rack is moved by a gear along the tube lane between the injection header and the suction header. The tubular member includes a head having two or more nozzles which emit pulsating fluid jets substantially perpendicular to the line of travel along the tube lane. In this manner, the pulsating fluid jet forces sludge to the periphery of the cylindrical tube sheet where the sludge is entrained in and carried away by the circumferential fluid stream.

After a sludge lancing operation, a cleanliness inspection must be performed. Subsequently, the conventional sludge lancing equipment is removed and the conventional inspection and/or retrieval equipment is installed. In the event that the steam generator is not cleaned satisfactorily, the inspection and/or retrieval equipment is removed and the sludge lancing equipment is reinstalled and the process is repeated. However, during such removals and installations, sludge lancing and inspection personnel for nuclear steam generators are exposed to increased levels of radiation at the handhole.

There is a need, therefore, for an apparatus which permits a cleanliness inspection to be performed without unnecessarily exposing inspection personnel to radiation.

There is a more particular need for such an apparatus which permits foreign objects discovered by the cleanliness inspection to be retrieved in conjunction with the inspection.

There is also a need for an improved sludge lancing apparatus which permits a cleanliness inspection to be performed without unnecessarily exposing inspection personnel to radiation.

SUMMARY OF THE INVENTION

These and other needs are satisfied by the invention which is directed to an apparatus for use with a search device and a foreign object extrication device in a heat exchanger. The apparatus may incorporate a router, which includes a plurality of conduits for routing the search device and the extrication device, and a positioning mechanism for positioning the output of each of the conduits within the heat exchanger. Each of the conduits may have an input, which is outside of the heat exchanger, and an output, which is inside of the heat exchanger. The conduits may include a first conduit for routing the search device and a second conduit for routing the extrication device. The positioning mechanism may position the first conduit and the second conduit within the heat exchanger. The router may also include a rack having a plurality of gear teeth for driving the rack. The positioning mechanism may include a gear mechanism for driving the gear teeth of the rack.

The extrication device may be a pushing device, which is pushed within one of the conduits, for pushing a foreign object within the heat exchanger. The extrication device may include a cable having a pushing mechanism for pushing the foreign object and a hook mechanism for pulling the foreign object. Alternatively, the extrication device may include a loop mechanism for pulling the foreign object.

The heat exchanger may include a plurality of tube rows and a tube lane. The router may further include a first guide tube, which is interconnected with the first conduit for guiding the search device from the tube lane into a selected one of the tube rows, and a second guide tube, which is interconnected with the second conduit for guiding the extrication device from the tube lane into the selected one of the tube rows. The heat exchanger may further include an annulus. The first guide tube may guide the search device into the annulus and the second guide tube may guide the extrication device into the annulus. The router may also include an attachment mechanism for removably attaching the first guide tube to the first conduit and for removably attaching the second guide tube to the second conduit.

Alternatively, an apparatus may be adapted for use with a sludge lancing system in a heat exchanger having a first half and a second half which are separated by a tube lane. The sludge lancing system may include a positioning device for positioning a sludge lance nozzle within the tube lane and, also, for positioning a search device and an extrication device within the heat exchanger. The apparatus may include a router having a first conduit for routing the search device in the first half of the heat exchanger, a second conduit for routing the extrication device in the first half, a third conduit for routing the search device in the second half of the heat exchanger, and a fourth conduit for routing the extrication device in the second half. The router may be positioned by the positioning device within the tube lane.

The extrication device may be a pushing device for pushing a foreign object within the heat exchanger. The pushing device may be pushed within at least one of the second conduit and the fourth conduit. The extrication device may include a cable having a slotted end for pushing a foreign object within the heat exchanger and, also, having a pulling mechanism for pulling the foreign object. Alternatively, the cable of the extrication device may have an anvil for pushing. The cable may be a woven steel cable for pushing and pulling.

The router may further include a first guide tube interconnected with the first conduit for guiding the search device from the tube lane into a selected one of the plurality of tube rows in the first half of the heat exchanger, a second guide tube interconnected with the second conduit for guiding the extrication device from the tube lane into the selected one of the tube rows in the first half, a third guide tube interconnected with the third conduit for guiding the search device from the tube lane into the selected one of the tube rows in the second half of the heat exchanger, and a fourth guide tube interconnected with the fourth conduit for guiding the extrication device from the tube lane into the selected one of the tube rows in the second half. The router may include a first input for inserting the search device therein and a second input for inserting the extrication device therein. The first input may be interconnected with the first and third conduits, and the second input may be interconnected with the second and fourth conduits.

Alternatively, the annulus may have a first half and a second half which are separated by the tube lane. The router may include a first guide tube interconnected with the first conduit for guiding the search device from the handhole into the first half of the annulus, a second guide tube interconnected with the second conduit for guiding the extrication device from the handhole into the first half, a third guide tube interconnected with the third conduit for guiding the search device from the handhole into the second half of the annulus, and a fourth guide tube interconnected with the fourth conduit for guiding the extrication device from the handhole into the second half.

Alternatively, an apparatus adapted for use with a sludge lancing system having a positioning device for a sludge lance nozzle may include a router having a first conduit and a second conduit for positioning by the positioning device within the heat exchanger, a first guide mechanism guided by the router for guiding the search device, a second guide mechanism guided by the router for guiding the extrication device, and a connection mechanism for removably connecting the first conduit to the first guide mechanism and the second conduit to the second guide mechanism. The router may be interchangeable with the sludge lance nozzle. The two conduits may extend from outside of the heat exchanger to inside of the heat exchanger.

The first guide mechanism may include a first guide tube and a second guide tube for the search device. The second guide mechanism may include a third guide tube and a fourth guide tube for the extrication device. The first and third guide tubes may terminate in the first half of the heat exchanger, and the second and fourth guide tubes may terminate in the second half. The connection mechanism may include a first Y-conduit for connecting the first conduit with the first and third guide tubes. The connection mechanism may also include a second Y-conduit for connecting the second and fourth guide tubes. Alternatively, the first and third guide tubes may terminate in the first half of the annulus, and the second and fourth guide tubes may terminate in the second half of the annulus.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
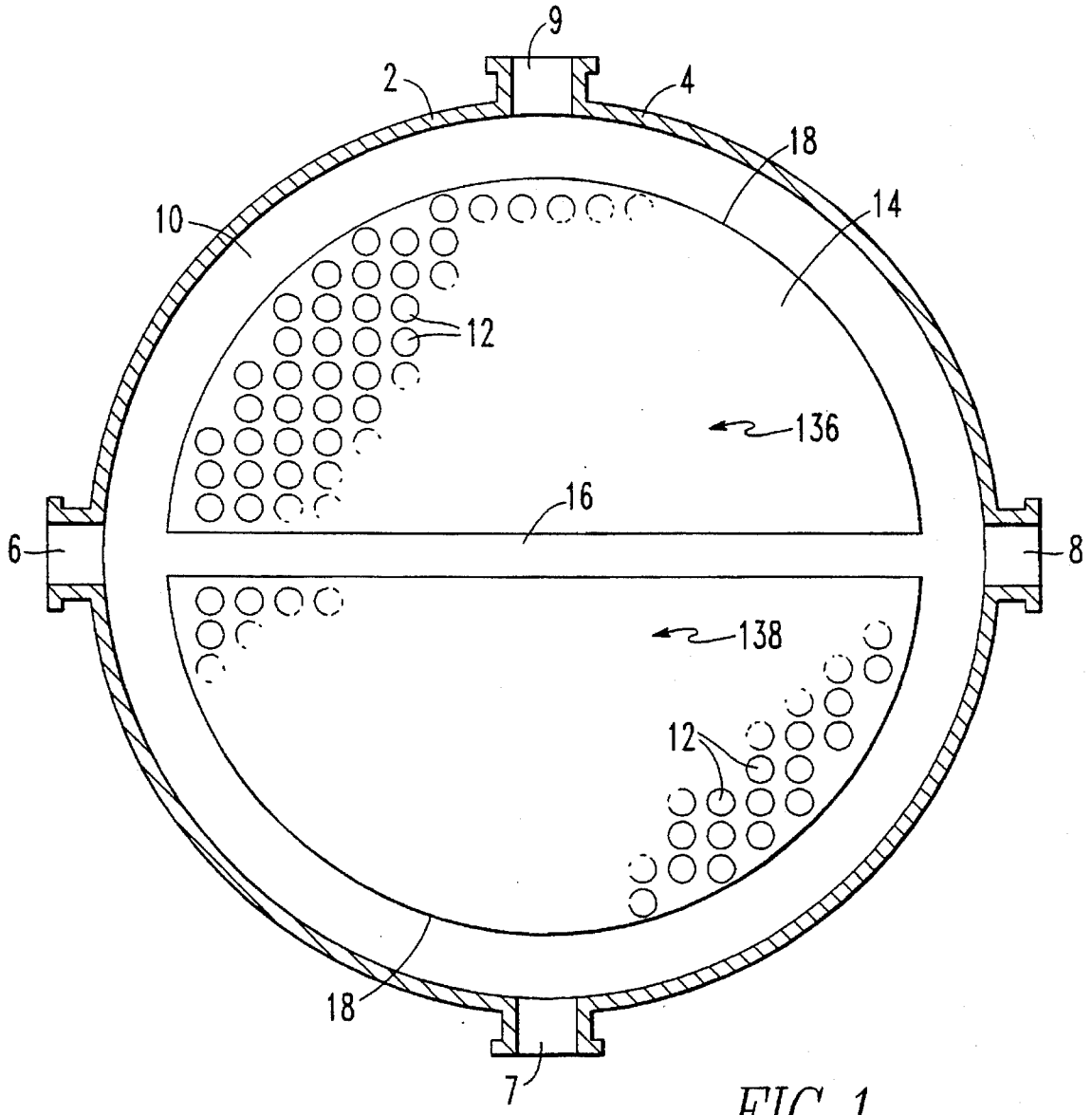
FIG. 1 PRIOR ART
FIG. 1 is a sectioned plan view of a conventional nuclear steam generator having four handhole openings.

Referring to FIG. 1, a sectioned plan view of a conventional nuclear steam generator 2 is illustrated, it being understood that the invention is applicable to a variety of heat exchangers, such as fossil steam generators or reheaters. The steam generator 2 includes an outer cylindrical shell 4 and four exemplary openings 6,7,8,9 which are generally referred to as handholes, it being understood that the steam generator 2 may have any number of handholes. Immediately inside the shell 4 is an annulus 10. The steam generator 2 further includes a plurality of closely spaced vertical tubes 12 supported by and extending upwardly from a tube sheet 14. The vertical tubes 12 are associated by pairs with a U-bend at the top (not shown) so as to straddle two sides of an aisle or tube lane 16 extending centrally across the shell 4 between the handholes 6,8. In the exemplary embodiment, the tubes 12 are surrounded by a wrapper barrel 18 spaced approximately two inches from the interior wall of the shell 4 to form the annulus 10, therewith. The exemplary wrapper barrel 18 and, consequently, the annulus 10, extend downwardly to a point which is approximately thirteen inches above the tube sheet 14.

Figure 2:
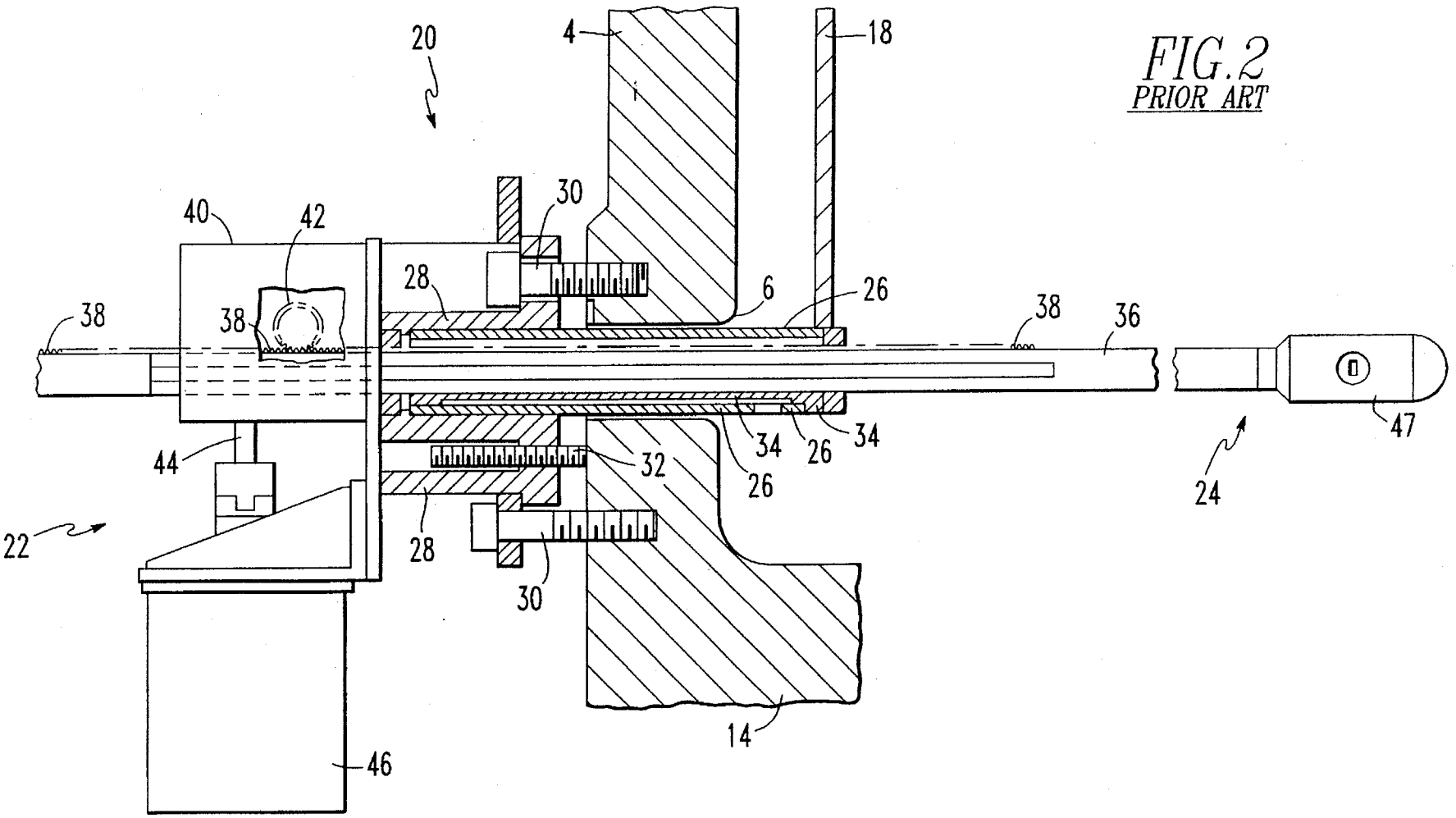
FIG. 2 PRIOR ART
FIG. 2 is a cross-sectional view of a sludge lancing system including a positioning device and a tubular nozzle member which extends through a handhole of a steam generator.

Referring now to FIG. 2, a cross-sectional view of a fluid lance 20 is illustrated. The fluid lance 20 includes a positioning device 22 and a tubular nozzle member or sludge lance nozzle 24 which extends through the exemplary handhole 6 of the steam generator 2 of FIG. 1. The fluid lance 20 also includes a first tubular member 26 which may be formed of 304 stainless steel and which is capable of being extended through the handhole 6. The first tubular member 26 is attached to a mounting plate 28 which supports the first tubular member 26. The mounting plate 28 has a plurality of holes 29 (shown in FIG. 3) therein so as to accommodate plural bolts 30. The bolts 30 are provided for attaching the mounting plate 28 to the shell 4 in a manner to support the fluid lance 20 while it is disposed through the handhole 6. The mounting plate 28 also has a plurality of holes 31 (shown in FIG. 3) therein for accommodating jack screws 32 which are provided for aligning the mounting plate 28 with respect to the shell 4 and the handhole 6.

The fluid lance 20 also includes a second tubular member 34 which is disposed within the first tubular member 26. The first tubular member 26 and the second tubular member 34 are joined by a sectional member (as described in U.S. Pat. No. 4,276,856).

The fluid lance 20 includes a third tubular member 36 which is slidably disposed within second tubular member 34. The third tubular member 36 has a rack 38 disposed on the top portion thereof which is sized to fit through a slot 39 (shown in FIG. 3). A gear box 40 is attached to the mounting plate 28 and has a first gear 42 disposed therein. The first gear 42 is arranged to contact and drive the rack 38. The first gear 42 is also connected to a drive line 44 which, in turn, is connected to a stepping motor 46. The exemplary 110 ounce-inch stepping motor 46 is electrically connected to common instrumentation for activating the drive line 44. The drive line 44 turns the first gear 42 thus moving the rack 38 in or out of the shell 4 in response to input from a sludge lance operator. In turn, the movement of rack 38 causes the third tubular member 36 to be moved into or out of the shell 4 by sliding through the second tubular member 34. It can be seen that the stepping motor 46 provides a drive mechanism by which the third tubular member 36 may be moved a predetermined distance along the tube lane 16 of FIG. 1 by using controls located outside of the steam generator 2 of FIG. 1. The sludge lance nozzle 24 includes the exemplary third tubular member 36 and a spray nozzle 47 which is attached at the end of the third tubular member 36.

Figure 3:
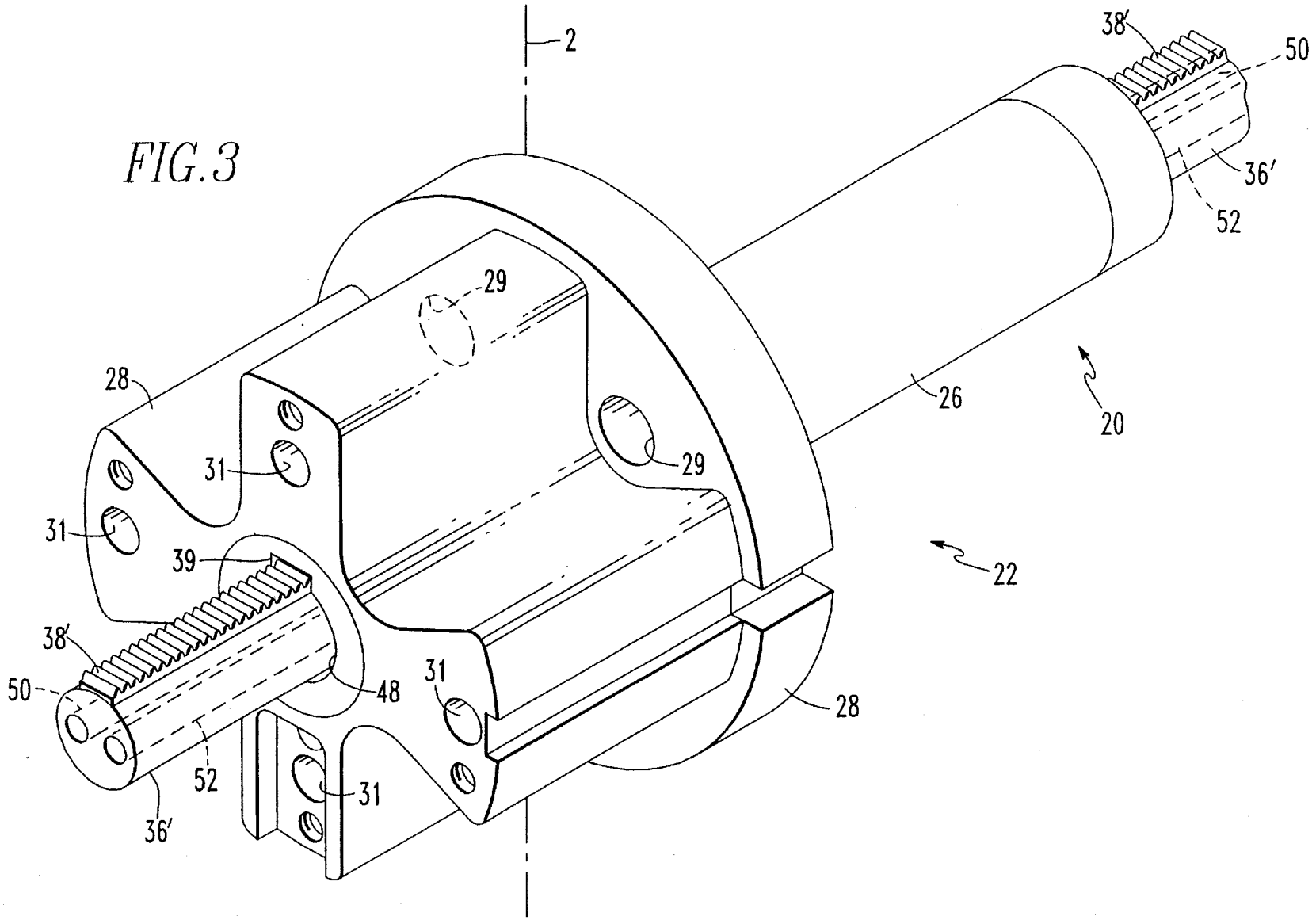
FIG. 3 is an isometric view of an outer end of a positioning device in accordance with the invention.

FIG. 3 is an isometric view of an outer end of the positioning device 22 of the fluid lance 20. The first tubular member 26 extends into the steam generator 2 (shown in shadow). An alternative third tubular member 36' replaces the third tubular member 36 and the spray nozzle 47 of FIG. 2. The mounting plate 28 includes the holes 29 and 31 for the bolts 30 and the jack screws 32, respectively, of FIG. 2. The mounting plate 28 also includes a hole 48 having the slot 39. The hole 48 and the slot 39 accept the exemplary third tubular member 36'. The third tubular member 36' includes a rack 38' and two conduits 50,52 (shown in shadow) which extend from outside of the steam generator 2 to inside of the steam generator 2.

Figure 4:
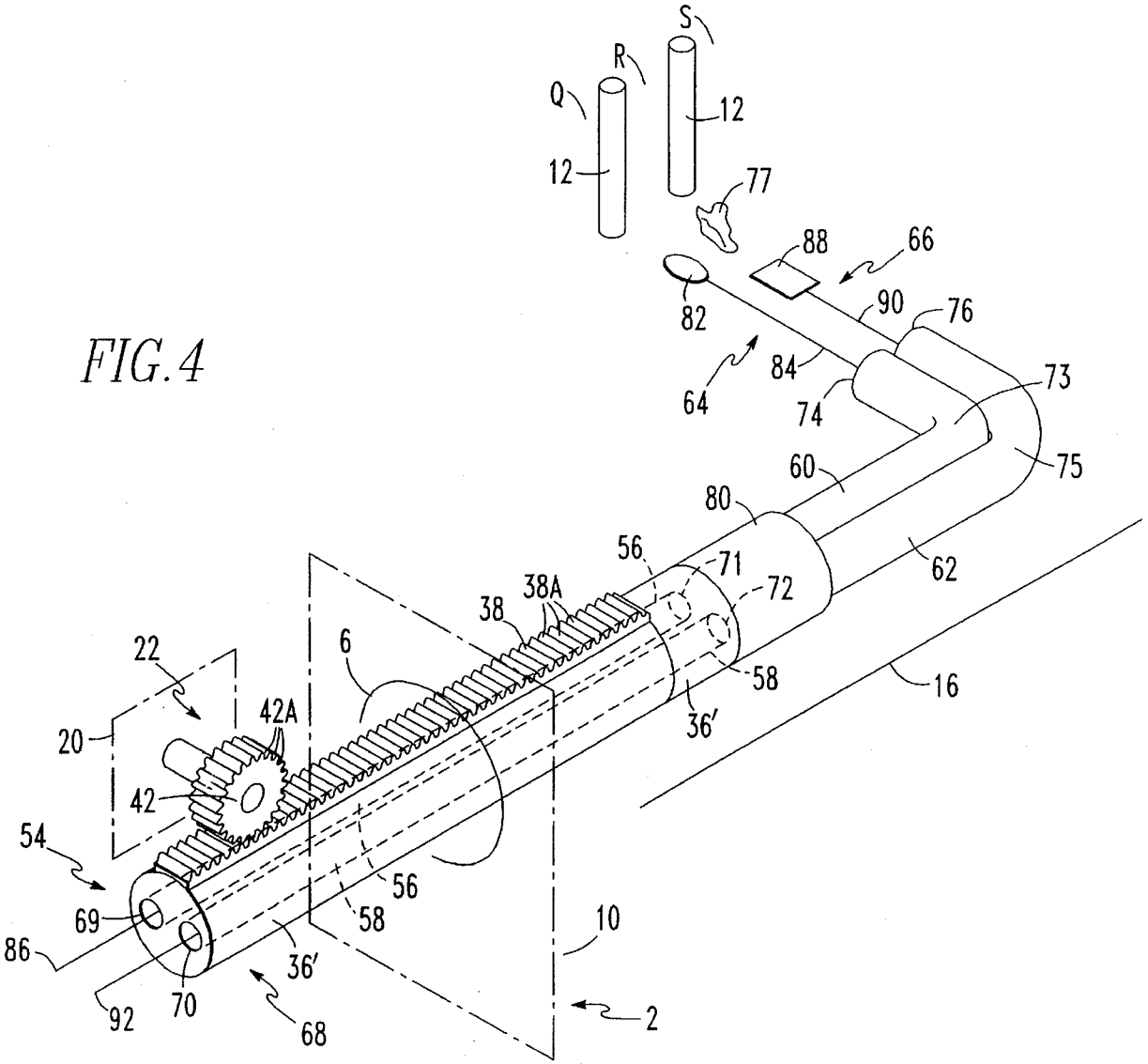
FIG. 4 is an isometric view of a router having two conduits, two detachable guide tubes, a search device and an extrication device in accordance with an embodiment of the invention.

FIG. 4 illustrates an isometric view of a router 54 having two conduits 56,58 (shown in shadow), two detachable guide tubes 60,62, a search device 64, and a foreign object extrication device 66. FIG. 4 also illustrates an inspection apparatus 68 for use with the search device 64 and the extrication device 66 in the steam generator 2 (shown in shadow). The inspection apparatus 68 includes the router 54 and the fluid lance 20 (shown in shadow) having the positioning device 22 and the gear 42.

The router 54 includes the conduits 56 and 58 for routing the search device 64 and the extrication device 66, respectively. The conduits 56,58 have inputs 69,70, respectively, which are outside of the steam generator 2 at the exemplary handhole 6. The conduits 56,58 also have outputs 71,72 (shown in shadow), respectively, which are inside of the steam generator 2. The positioning device 22 positions the outputs 71,72 of the conduits 56,58, respectively, within the steam generator 2. As discussed above with FIG. 3, the router 54 also includes the rack 38 having a plurality of rack teeth 38A for driving the rack 38.

The exemplary positioning device 22 is utilized with the third tubular member 36 and the attached spray nozzle 47 of FIG. 2, with the third tubular member 36' of FIG. 3, or with the router 54 of FIG. 4. Accordingly, the router 54 is interchangeable with the sludge lance nozzle 24 of FIG. 2. The positioning device 22 further includes the gear 42 having a plurality of gear teeth 42A for driving the rack teeth 38A. The positioning device 22 positions the conduits 56,58 within the steam generator 2.

The first conduit 56 routes the search device 64 and the second conduit 58 routes the extrication device 66. The exemplary detachable guide tube 60, which is interconnected with the first conduit 56, has a right-angle bend 73 and an output 74 for guiding the search device 64 from the tube lane 16 into a selected row R of the rows Q,R,S between the tubes 12. The exemplary detachable guide tube 62, which is interconnected with the second conduit 58, has a right-angle bend 75 and an output 76 for guiding the extrication device 66 from the tube lane 16 into the selected row R between the tubes 12. The exemplary router 54 further includes a removable attachment 80 having a quick release or bayonet mount. The attachment 80 removably interconnects the guide tubes 60,62 to the conduits 56,58, respectively, at the end of the third tubular member 36'. The positioning device 22 positions the output 74,76 of each of the guide tubes 60,62 within the steam generator 2.

The exemplary search device 64 includes an inspection probe 82 (e.g., a fiberscope, a video probe, a miniature television camera, etc.) having a light source (not shown), a cable 84 having one or more optical fibers (not shown), and a receiving end 86 for viewing the inside of the steam generator 2 and for maneuvering the probe 82 within the steam generator 2. A non-limiting example of the search device 64 is a model VS231 video probe marketed by Welch Allyn, it being understood that the present invention is applicable to a wide variety of search devices, including such devices suitable for underwater operation.

The exemplary extrication device 66, which is discussed in greater detail below with FIGS. 7A–7B, includes an extrication end 88, a cable 90, and a control end 92 for controlling and maneuvering the extrication end 88 within the steam generator 2. The extrication end 88 is suitable for dislodging a foreign object 77 within the steam generator 2 by pushing or pulling the foreign object 77. The exemplary cable 90, at the control end 92 thereof, is manually pushed or pulled by an inspection operator. Alternatively, the cable 90 is driven by a remote operating mechanism (not shown). Those skilled in the art will appreciate that the exemplary inspection apparatus 68 may be used with other devices (e.g., a retrieval device marketed by Wolf & Company as model 1.50600.00; or any retrieval device having a retrieving mechanism such as a fork having fines, a pair of viper jaws, a magnet, a suction device providing a vacuum, etc.) which are suitable for retrieving foreign objects 77 from the steam generator 2.

The sludge lance nozzle 24 of FIG. 2 is first used for cleaning the tubes 12 of the steam generator 2. Then, as discussed in greater detail below with FIGS. 5A, 5B, 6, 7A and 7B, the sludge lance nozzle 24, which includes the third tubular member 36 of FIG. 2, is conveniently replaced by the router 54, which facilitates the location and extrication of foreign objects 77 within the steam generator 2. Furthermore, whenever two sludge lance nozzles 24 are used from both of the handholes 6,8 of FIG. 1, an inspection operation may be performed from one of the handholes 6,8 while sludge lancing continues from the other of the handholes 6,8.

The cables 84 and 90 of the search device 64 and the extrication device 66, respectively, extend through the handhole 6 and are utilized for positioning the respective devices 64,66 within the steam generator 2. In this manner, the two guide tubes 60,62 may guide the search device 64 and the extrication device 66 from the handholes 6,8 of FIG. 1, through the annulus 10, and onto the tube sheet 14 of the steam generator 2. Alternatively, the two guide tubes 60,62 may guide the devices 64,66 from the handholes 6,8 into the annulus 10. Preferably, the receiving end 86 and the control end 92 of the respective cables 84 and 90 include a remote 4-way articulating capability which provides greater maneuverability of the respective devices 64,66 within the steam generator 2.

The exemplary stainless steel pair of guide tubes 60,62 includes a first stainless steel conduit or tube 60 which is attached beside a second stainless steel conduit or tube 62. Other equivalent pairs of guide tubes 60,62, however, are possible, such as a segmented pair of guide tubes, a pair of guide tubes having a rectangular shape, a single conduit having two or more tubes 60,62 routed therethrough, or a single conduit which is divided into two internal sections for the search device 64 and the extrication device 66. Furthermore, other suitable materials, such as nylon, are also possible.

Figure 5A:
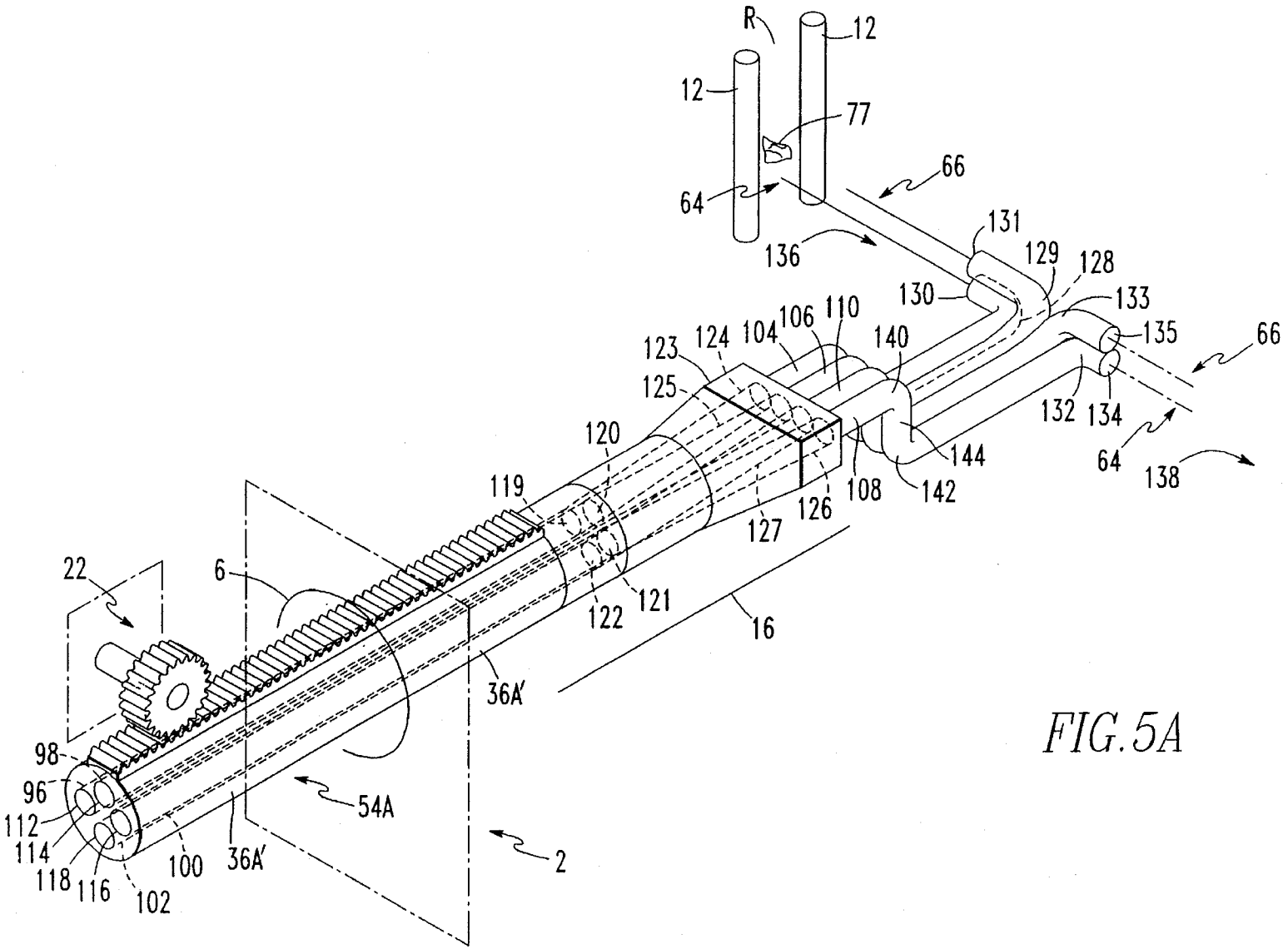
FIG. 5A is an isometric view of another router having four conduits and four detachable guide tubes for the tube lane in accordance with an alternative embodiment of the invention.

FIG. 5A is an isometric view of another router 54A having four conduits 96,98,100,102 (shown in shadow) and four detachable right-angle guide tubes 104,106,108,110, respectively, for the tube lane 16 of FIGS. 1 and 4. In a manner similar to the router 54 of FIG. 4, the router 54A is utilized with the positioning device 22 (shown in shadow) of FIGS. 3–4 in order to position the search device 64 and the extrication device 66 within the steam generator 2 (shown in shadow).

The conduits 96,98,100,102 have inputs 112,114,116,118, respectively, which are outside of the steam generator 2 and, also, have outputs 119,120,121,122 (shown in shadow), respectively, which are inside of the steam generator 2. The positioning device 22 positions these outputs 119,120,121, 122 within the steam generator 2. A removable attachment 123 having a quick release or bayonet mount includes four conduits 124,125,126,127 (shown in shadow) which removably interconnect the guide tubes 104,106,108,110 to the conduits 96,98,100,102, respectively, at the end of the third tubular member 36A'.

The conduits 96,100; the conduits 124,126; and the guide tubes 104,108 route the search device 64. The conduits 98,102; the conduits 125,127; and the guide tubes 106,110 route the extrication device 66. The exemplary detachable guide tubes 104,106 have right-angle bends 128 (shown in shadow), 129 and outputs 130,131 for guiding the devices 64,66, respectively, from the tube lane 16 into the selected row R between the tubes 12. The exemplary detachable guide tubes 108,110 have right-angle bends 132,133 and outputs 134,135 for guiding the devices 64,66, respectively, from the tube lane 16 into the selected row R between the tubes 12.

The output 119 of the conduit 96 and the output 130 of the guide tube 104 route the search device 64 in a first half 136 of the steam generator 2 (as best shown in FIG. 1). The output 120 of the conduit 98 and the output 131 of the guide tube 106 route the extrication device 66 in this first half 136. Similarly, the output 121 of the conduit 100 and the output 134 of the guide tube 108 route the search device 64 (shown in shadow) in a second half 138 of the steam generator 2 (as best shown in FIG. 1). The output 122 of the conduit 102 and the output 135 of the guide tube 110 route the extrication device 66 (shown in shadow) in this second half 138.

The positioning device 22, thus, positions the outputs 130,131,134,135 of the corresponding guide tubes 104,106, 108,110 within the steam generator 2. Each of the guide tubes 104,106,108,110 has two right-angle bends 140,142 and a vertical section 144 therebetween for accommodating the height of the handholes 6,8 above the tube lane 16 of FIG. 1.

Figure 5B:
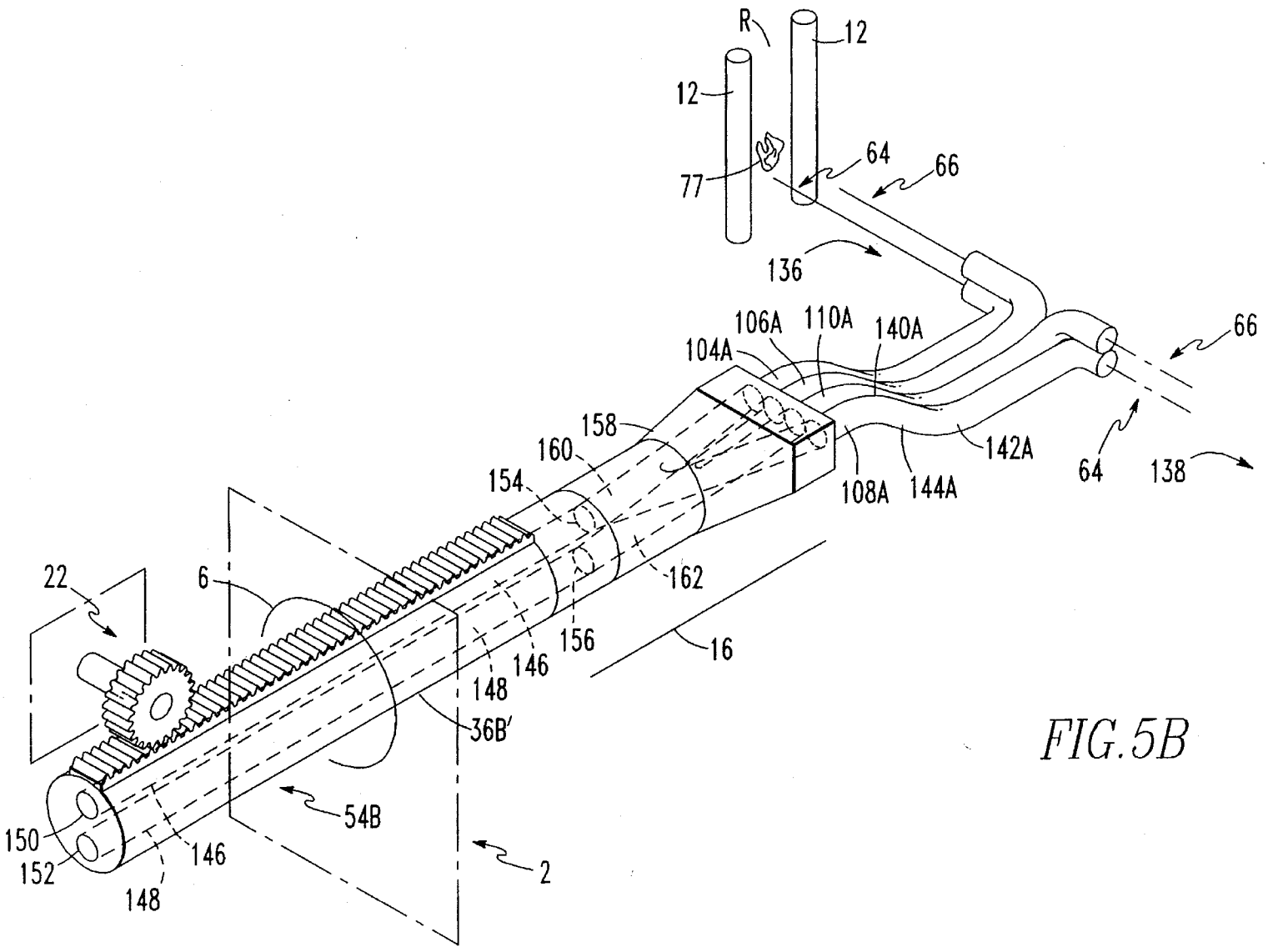
FIG. 5B is an isometric view of another router having two conduits and four detachable guide tubes for the tube lane in accordance with another alternative embodiment of the invention.

FIG. 5B is an isometric view of another router 54B having two conduits 146,148 (shown in shadow) and four detachable right-angle guide tubes 104A,106A,108A,110A, respectively, for the tube lane 16 of FIGS. 1 and 4. The router 54B is utilized with the positioning device 22 of FIGS. 3–4, in a manner similar to the router 54A of FIG. 5A, in order to position the search device 64 and the extrication device 66 within the steam generator 2 (shown in shadow).

The conduits 146,148 have inputs 150,152, which are outside of the steam generator 2 and, also, have outputs 154,156 (shown in shadow), respectively, which are inside of the steam generator 2. The positioning device 22 positions these outputs 154,156 within the steam generator 2. A removable attachment 158 having a quick release or bayonet mount includes Y-conduits 160,162 (shown in shadow). The Y-conduit 160 interconnects the guide tubes 104A,108A with the output 154 of the conduit 146. The Y-conduit 162 interconnects the guide tubes 106A,110A with the output 156 of the conduit 148. Thus, the attachment 158 removably interconnects the guide tubes 104A,106A,108A,110A to the conduits 146,148,146,148, respectively, at the end of the third tubular member 36B'. Thus, the input 150 of the first conduit 146 is interconnected with the guide tubes 104A, 108A. Similarly, the input 152 of the second conduit 148 is interconnected with the guide robes 106A,110A.

The conduit 146, the Y-conduit 160, and the guide tubes 104A,108A route the search device 64. The conduit 148, the Y-conduit 162, and the guide tubes 106A,110A route the extrication device 66. In a related manner as the guide tubes 104,106,108,110 of FIG. 5A, each of the guide robes 104A, 106A,108A,110A has two 45 degree bends 140A,142A and a section 144A therebetween for accommodating the height of the handholes 6,8 above the tube lane 16 of FIG. 1, the only difference between the guide tubes of FIGS. 5A and 5B being the exemplary vertical section 144 of FIG. 5A and the exemplary 45 degree section 144A of FIG. 5B.

Figure 6:
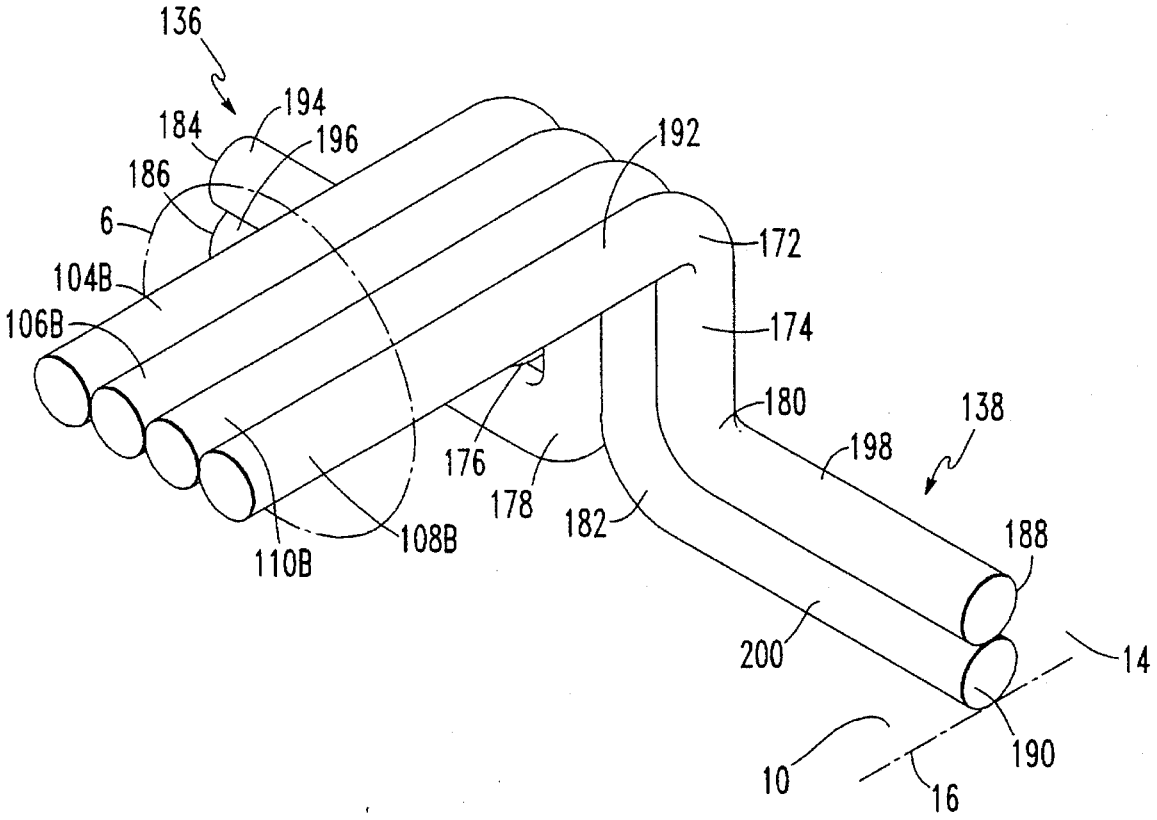
FIG. 6 is an isometric view of four guide tubes for the annulus and the tube lane in accordance with another alternative embodiment of the invention.

FIG. 6 is an isometric view of four alternative guide tubes 104B,106B,108B,110B for use with the exemplary routers 54A,54B of FIGS. 5A,5B, respectively, in both the annulus 10 and the tube lane 16 of FIG. 4. Each of the exemplary guide tubes 104B,106B,108B,110B includes an upper right-angle bend 172 and a vertical section 174 for accommodating the height of the handholes 6,8 above the tube sheet 14 of FIG. 1. The guide tubes 104B,106B,108B,110B further include lower right-angle bends 176,178,180,182 and outputs 184,186,188,190, respectively.

The vertical section 174 is bent at a fight angle with respect to a main section 192. Four lower sections 194,196, 198,200 are bent at a fight angle with respect to the vertical section 174. Two of the lower sections 196,200, which rest on and are parallel to the surface of the tube sheet 14, are bent at a fight angle with respect to the main section 192. The other two lower sections 194,198 rest on the sections 196,200, respectively. In this manner, the outputs 184,186 of the guide tubes 104B,106B, respectively, are directed to the first half 136 of the steam generator 2 of FIG. 1. Similarly, the outputs 188,190 of the guide tubes 108B,110B, respectively, are directed to the second half 138 of the steam generator 2. The positioning device 22 of FIGS. 3–4, thus, positions the outputs 184,186,188,190 of the guide tubes 104B,106B,108B,110B, respectively, within the annulus 10 or the tube lane 16 of the steam generator 2.

Figure 7A:
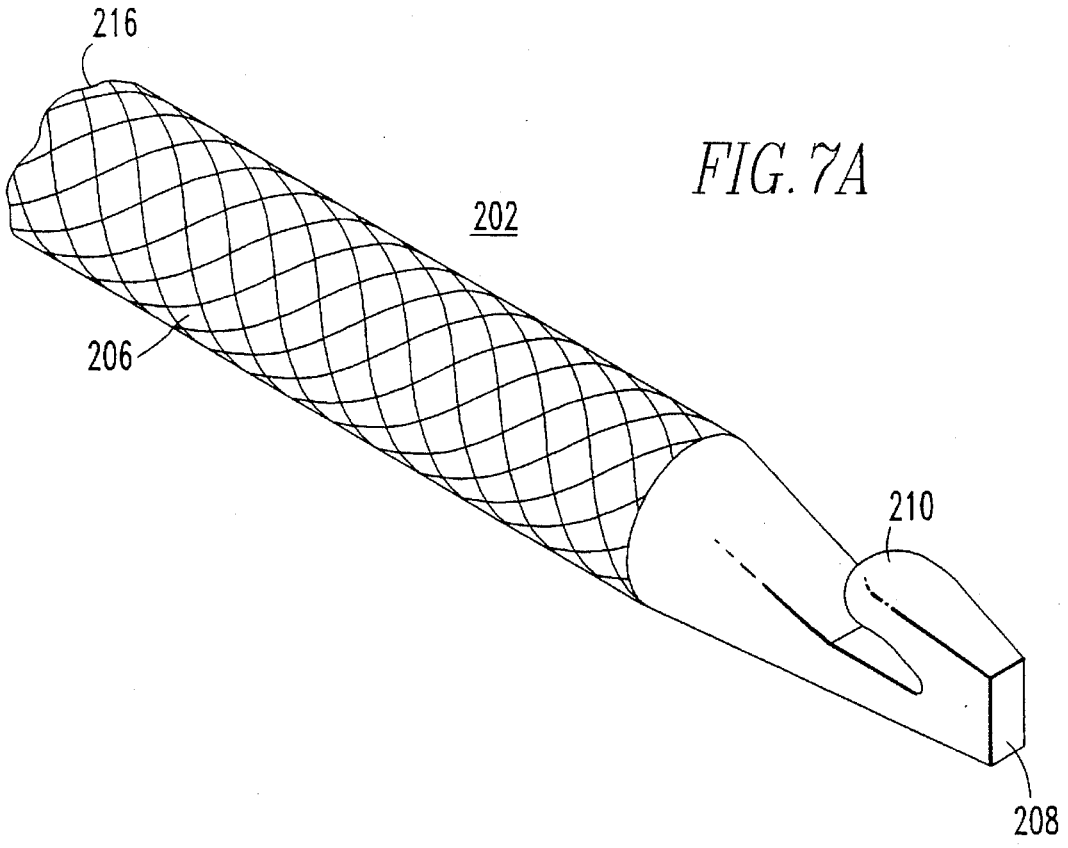
FIG. 7A is an isometric view of an extrication device in accordance with an embodiment of the invention.
Figure 7B:
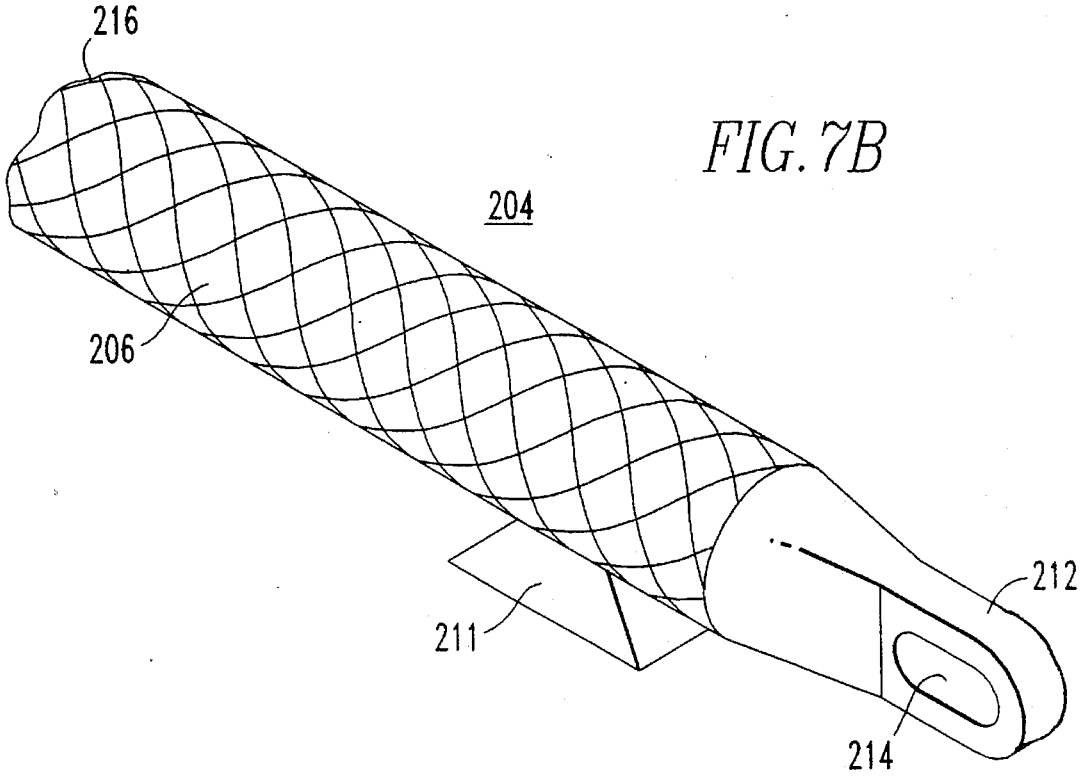
FIG. 7B is an isometric view of another extrication device in accordance with an alternative embodiment of the invention.

Referring now to FIGS. 7A and 7B, exemplary extrication devices 202 and 204, respectively, are illustrated. The extrication device 202 includes an exemplary woven stainless steel cable 206, a slotted end 208 for pushing, and a hook 210 for pulling the foreign object 77 of FIG. 4 within the steam generator 2 of FIG. 1. The extrication device 204 includes the cable 206, a trapezoidal anvil end 211 for pushing, and a loop 212 having a hole 214 for pulling. A non-limiting example of the cable 206 is a woven 0.25 inch diameter 7×19 strand core stainless steel cable marketed by McMaster-Carr, it being understood that other materials, such as galvanized or carbon steel, and other weaves and diameters are possible. The cable 206 may be manipulated left/right and up/down by appropriately twisting the control end 216.

The exemplary extrication devices 202,204 are pushing and pulling devices for pushing and pulling the cable 206 and the foreign object 77 of FIG. 4 within the steam generator 2 of FIG. 1. The cable 206 of these devices 202,204 is pulled and pushed within the exemplary routers 54, 54A and 54B of FIGS. 4, 5A and 5B; and within the exemplary guide tubes 62, 106–110, 106A–110A and 106B–110B of FIGS. 4, 5A, 5B and 6, respectively. Those skilled in the art will appreciate that the exemplary cable 206 may be manipulated manually by an inspection operator or automatically manipulated by a remote operating mechanism (not shown).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An apparatus for use with a search device and a foreign object extrication device in a heat exchanger, said apparatus comprising:

routing means including a plurality of conduits for routing said search device and said extrication device, each of the plurality of conduits having an input which is outside of said heat exchanger and an output which is inside of said heat exchanger; and positioning means for positioning the output of each of the plurality of conduits within said heat exchanger.

2. The apparatus as recited in claim 1 wherein said routing means further includes a rack means having a plurality of gear teeth for driving the rack means, and wherein said positioning means includes a gear means for driving the gear teeth of said rack means.

3. The apparatus as recited in claim 2 wherein the plurality of conduits includes a first conduit for routing said search device and a second conduit for routing said extrication device, and wherein said positioning means positions the first conduit and the second conduit within said heat exchanger.

4. The apparatus as recited in claim 3 wherein said heat exchanger includes a plurality of tube rows and a tube lane, and wherein said routing means further includes a first guide tube interconnected with the first conduit for guiding said search device from the tube lane into a selected one of the plurality of tube rows and a second guide tube interconnected with the second conduit for guiding said extrication device from the tube lane into the selected one of the plurality of tube rows.

5. The apparatus as recited in claim 4 wherein said heat exchanger further includes an annulus, and wherein the first guide tube also guides said search device into the annulus and the second guide tube also guides said extrication device into the annulus.

6. The apparatus as recited in claim 3 wherein said routing means further includes a first guide tube interconnected with the first conduit, a second guide tube interconnected with the second conduit, and attachment means for removably attaching the first guide tube to the first conduit and for removably attaching the second guide tube to the second conduit.

7. The apparatus as recited in claim 1 wherein said extrication device is a pushing device for pushing a foreign object within said heat exchanger, and wherein the pushing device is pushed within one of the plurality of conduits.

8. The apparatus as recited in claim 1 wherein said extrication device includes a cable having pushing means for pushing a foreign object within said heat exchanger, the cable also having hook means for pulling the foreign object.

9. The apparatus as recited in claim 1 wherein said extrication device includes a cable having pushing means for pushing a foreign object within said heat exchanger, the cable also having loop means for pulling the foreign object.

10. An apparatus adapted for use with a sludge lancing system in a heat exchanger having a first half and a second half which are separated by a tube lane, said sludge lancing system including a positioning device for positioning a sludge lance nozzle within the tube lane, said positioning device also for positioning a search device and an extrication device within said heat exchanger, said apparatus comprising:

routing means for positioning by said positioning device within the tube lane, said routing means including first conduit means for routing said search device in the first half of said heat exchanger, second conduit means for routing said extrication device in the first half of said heat exchanger, third conduit means for routing said search device in the second half of said heat exchanger, and fourth conduit means for routing said extrication device in the second half of said heat exchanger.

11. The apparatus as recited in claim 10 wherein said extrication device is a pushing device for pushing a foreign object within said heat exchanger, and wherein the pushing device is pushed within at least one of said second conduit means and said fourth conduit means.

12. The apparatus as recited in claim 10 wherein said extrication device includes a cable having a slotted end for pushing a foreign object within said heat exchanger, the cable also having pulling means for pulling the foreign object.

13. The apparatus as recited in claim 10 wherein said extrication device includes a cable having anvil means for pushing a foreign object within said heat exchanger, the cable also having pulling means for pulling the foreign object.

14. The apparatus as recited in claim 10 wherein said extrication device includes about a woven steel cable for pushing and pulling a foreign object within said heat exchanger.

15. The apparatus as recited in claim 10 wherein said heat exchanger includes a plurality of tube rows and a tube lane, and wherein said routing means further includes a first guide tube interconnected with the first conduit means for guiding said search device from the tube lane into a selected one of the plurality of tube rows in the first half of said heat exchanger, a second guide tube interconnected with the second conduit means for guiding said extrication device from the tube lane into the selected one of the plurality of tube rows in the first half of said heat exchanger, a third guide tube interconnected with the third conduit means for guiding said search device from the tube lane into the selected one of the plurality of tube rows in the second half of said heat exchanger, and a fourth guide tube interconnected with the fourth conduit means for guiding said extrication device from the tube lane into the selected one of the plurality of tube rows in the second half of said heat exchanger.

16. The apparatus as recited in claim 10 wherein said heat exchanger also has a handhole and an annulus, the annulus having a first half and a second half which are separated by the tube lane; and wherein said routing means further includes a first guide tube interconnected with the first conduit means for guiding said search device from the handhole into the first half of the annulus, a second guide tube interconnected with the second conduit means for guiding said extrication device from the handhole into the first half of the annulus, a third guide tube interconnected with the third conduit means for guiding said search device from the handhole into the second half of the annulus, and a fourth guide tube interconnected with the fourth conduit means for guiding said extrication device from the handhole into the second half of the annulus.

17. The apparatus as recited in claim 10 wherein said routing means further includes a first input for inserting said search device therein and a second input for inserting said extrication device therein, the first input being interconnected with said first conduit means and said third conduit means, the second input being interconnected with said second conduit means and said fourth conduit means.

18. An apparatus adapted for use with a sludge lancing system in a heat exchanger, said sludge lancing system including a positioning device for positioning a sludge lance nozzle within said heat exchanger, said apparatus cooperating with said positioning device for positioning a search device and an extrication device within said heat exchanger, said apparatus comprising:

routing means for positioning by said positioning device within said heat exchanger, said routing means being interchangeable with said sludge lance nozzle and having a first conduit and a second conduit, the two conduits extending from outside of said heat exchanger to inside of said heat exchanger;

first guide means guided by said routing means for guiding said search device;

second guide means guided by said routing means for guiding said extrication device; and connection means for removably connecting the first conduit to said first guide means and the second conduit to said second guide means.

19. The apparatus as recited in claim 18 wherein said heat exchanger has a first half and a second half which are separated by a tube lane; wherein said first guide means includes a first guide tube and a second guide tube for said search device; wherein said second guide means includes a third guide tube and a fourth guide tube for said extrication device; wherein the first guide tube and the third guide tube terminate in the first half of said heat exchanger, and the second guide tube and the fourth guide tube terminate in the second half of said heat exchanger; and wherein said connection means includes a first Y-conduit for the first conduit, the first guide tube and the third guide tube, and also includes a second Y-conduit for the second conduit, the second guide tube and the fourth guide tube.

20. The apparatus as recited in claim 18 wherein said heat exchanger also has an annulus which has a first half and a second half which are separated by the tube lane; wherein said first guide means includes a first guide tube and a second guide tube for said search device; wherein said second guide means includes a third guide tube and a fourth guide tube for said extrication device; wherein the first guide tube and the third guide tube terminate in the first half of the annulus, and the second guide tube and the fourth guide tube terminate in the second half of the annulus; and wherein said connection means includes a first Y-conduit for the first conduit, the first guide tube and the third guide tube, and also includes a second Y-conduit for the second conduit, the second guide tube and the fourth guide tube.

* * * * *